US006041927A

United States Patent [19]

Vallve et al.

[11] Patent Number: 6,041,927

[45] Date of Patent: Mar. 28, 2000

[54] ANTI-ROTATIONAL SYSTEM

[75] Inventors: Raimundo Roca Vallve; Francisco Guerrero Mercado; Juan Ruiz Estrella; Andres Alvarez Vargas; Raul Gonzalez Alonso; Martin Cisneros Aguirre; Alfredo Cruz Cruz, all of Queretaro, Mexico

[73] Assignee: Plasticos Tecnicos Mexicanos, S.A. de C.V., Queretaro, Mexico

[21] Appl. No.: 09/127,803

[22] Filed: Aug. 3, 1998

[30] Foreign Application Priority Data

Mar. 2, 1998 [MX] Mexico ..... 980170

[51] Int. Cl.[7] ..... B65D 71/00

[52] U.S. Cl. ..... 206/427; 220/509

[58] Field of Search ..... 206/203, 427, 206/433; 220/509, 513, 516, 517, 518, 519

[56] References Cited

U.S. PATENT DOCUMENTS

| | | | |
|---|---|---|---|
| D. 350,438 | 9/1994 | Apps et al. . | |
| D. 356,500 | 3/1995 | Apps et al. . | |
| D. 356,950 | 4/1995 | Apps et al. . | |
| 2,526,113 | 10/1950 | Blackwell | 220/509 |
| 2,935,222 | 5/1960 | O'Connell | 220/509 |
| 5,320,245 | 6/1994 | Apps et al. . | |
| 5,405,042 | 4/1995 | Apps et al. . | |

*Primary Examiner*—Jacob K. Ackun
*Attorney, Agent, or Firm*—Oblon, Spivak, McClelland, Maier & Neustadt, P.C.

[57] ABSTRACT

An anti-rotational system which restrains containers therein from rotating and contacting adjacent containers so as not to abrade the outer surface of the containers features an exterior box having at least one wall having a height at least as great as a height of the containers. Furthermore, longitudinal ribs connect to the walls and to the bottom structure of the exterior box to form an elastic portion. The longitudinal ribs form sets of ribs which contact a diameter of the container which is smaller than a maximum diameter of the container so as to secure the position of the container. The longitudinal ribs flex so as to allow the maximum diameter region of the container to pass thereby. Once the maximum diameter region of the container has passed by the longitudinal ribs, the elastic characteristics of the longitudinal ribs allow the longitudinal ribs to flex back towards their original position thus ensuring that the longitudinal ribs contact the smaller diameter of the container. Furthermore, pairs of perpendicular ribs project up from the bottom structure to which they are attached to form a rigid portion. The pairs of perpendicular ribs are substantially located between the bottom structure and the longitudinal ribs. The pairs of perpendicular ribs have a dimension smaller than a diameter of the maximum diameter of the container and as such they come into contact with the maximum diameter of the container. The pairs of perpendicular ribs ensure that contact is maintained between the pairs of perpendicular ribs and the maximum diameter of the container. Such secure retention of the container in the anti-rotational box prevents the container stored in the anti-rotational box from contacting each other and therefore abrading the outer surfaces of the container. As such, the containers stored and transported in such an anti-rotational box allows the containers to be refilled and reused.

10 Claims, 6 Drawing Sheets

ANTI-ROTATIONAL SYSTEM

BACKGROUND OF THE INVENTION

1. Field of the Invention

This invention concerns a system for the storage of containers such as bottles. The invention more particularly concerns the retention of the bottles within a box so that the bottles do not rotate or contact each other which would result in the abrasion of the outer surface of the bottles. Such abrasions on the surface of the bottles render the bottles unusable for reuse.

This application claims priority of Mexican Patent Application No. 980170 which is hereby incorporated by reference.

2. Discussion of the Background

Previously existing boxes for the storage of bottles, which are used to transport the bottles from one location to another, have a number of shortcomings which result in the bottle being abraded on its outer surface. Such abrasions render the bottle unusable for refilling for reuse. Ideally, the boxes that hold the bottles would be capable of retaining in a single location each of the bottles so that the bottles do not contact each other.

Known prior art devices (Apps et al., U.S. Pat. Nos. 5,405,042 and 5,320,245, both of which are incorporated herein by reference) provide dividers which are insertable into a box so that the bottles can be handled. The prior art discloses that different dividers can be inserted into the box so as to accommodate bottles of different sizes within one type of box. However, the boxes of the prior art allow the bottles arranged by the dividers to contact each other causing abrasions on the outer surfaces.

Thus, there is a need for a system, such as a box, which stores containers, such as bottles, that prevents the bottles from contacting each other during storage and transportation.

SUMMARY OF THE INVENTION

It is an object of the invention to provide a system which stores containers that prevents the containers from contacting each other's outer surfaces.

In one form of the invention the anti-rotational system takes the form of an exterior box having at least one wall having a height at least as great as a height of the containers. Within the exterior box structure is located means for forming pockets which retain the containers in the box. The means for forming pockets include a first rigid portion and second elastic portion. The first rigid portion engages a maximum diameter of the container and the second elastic portion engages a diameter of the container which is smaller than the maximum diameter of the container with sufficient force so as to retain the container in the box. The containers have non-uniform diameters.

In yet another form of the invention the anti-rotational system takes the form of an anti-rotational box, similar to the anti-rotational box described above, where containers having a uniform diameter are securable within the pockets formed in the exterior box.

In still yet another form of the invention, the anti-rotational system takes the form of a general structural piece, such as a shelf, having pockets wherein containers are securable.

Thus, Applicant's invention is superior to the prior art. Applicant's invention provides an anti-rotational system that prevents the inserted containers from rotating and contacting adjacent containers. Therefore, the containers can be refilled for reuse since the design on the outer surface is still identifiable. Thus, conserving natural resources. Such structural features distinguish Applicant's invention, structurally and functionally, over the prior art.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
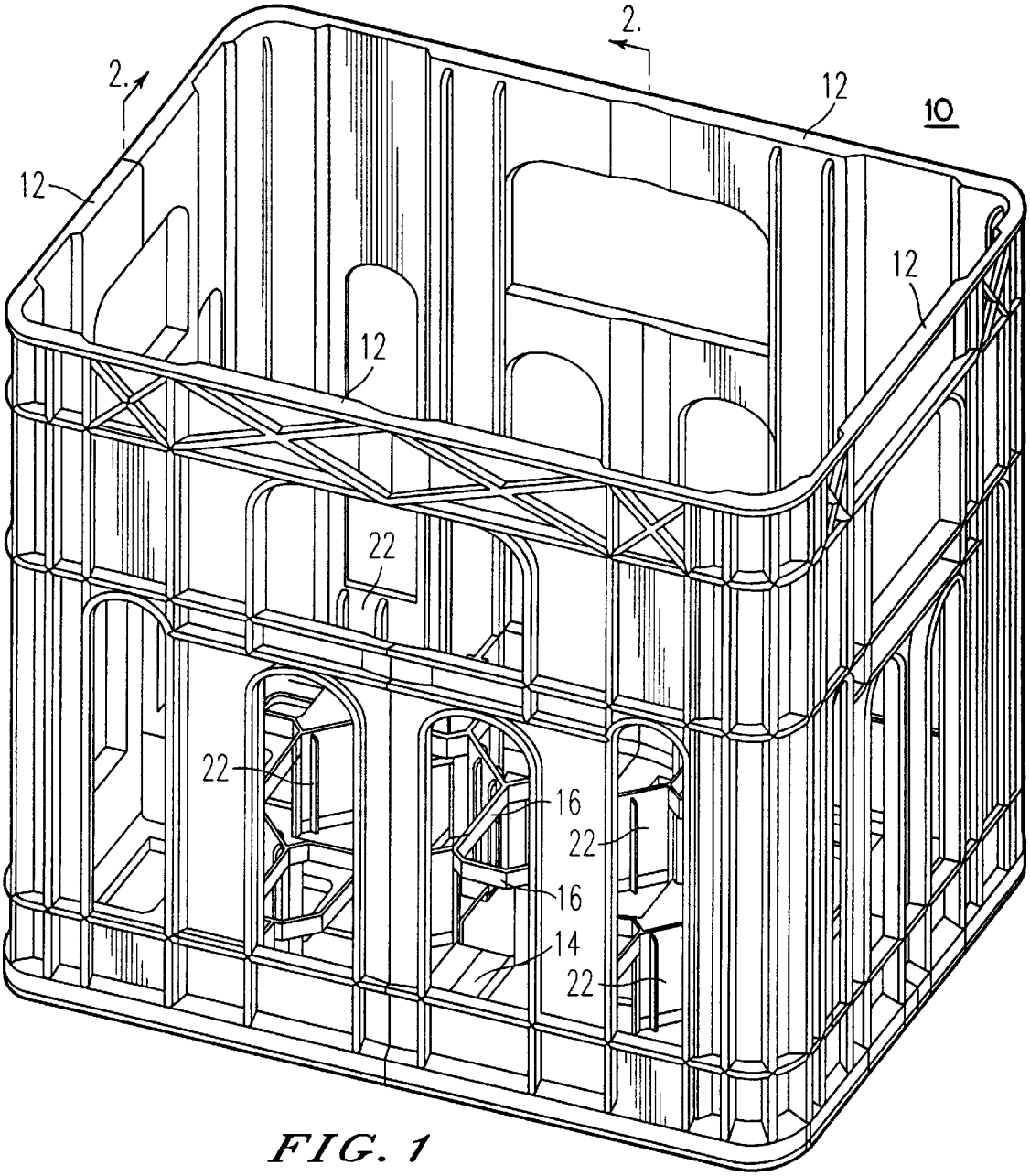
FIG. 1 is a perspective view of an anti-rotational box.

Referring now to the drawings, wherein like reference numerals designate identical or corresponding parts throughout the several views, and more particularly to FIG. 1 thereof, an anti-rotational box 10 has been created which provides for the anti-rotation of containers, such as bottles, inserted therein, which provides for abrasion resistance on the surfaces of the bottles due to rubbing of the bottles against adjacent bottles. The embodiment of this invention is displayed in FIGS. 1–6. FIG. 1 is a perspective view of the anti-rotational box 10 showing the full-depth walls 12 and the bottom structure 14.

Figure 2:
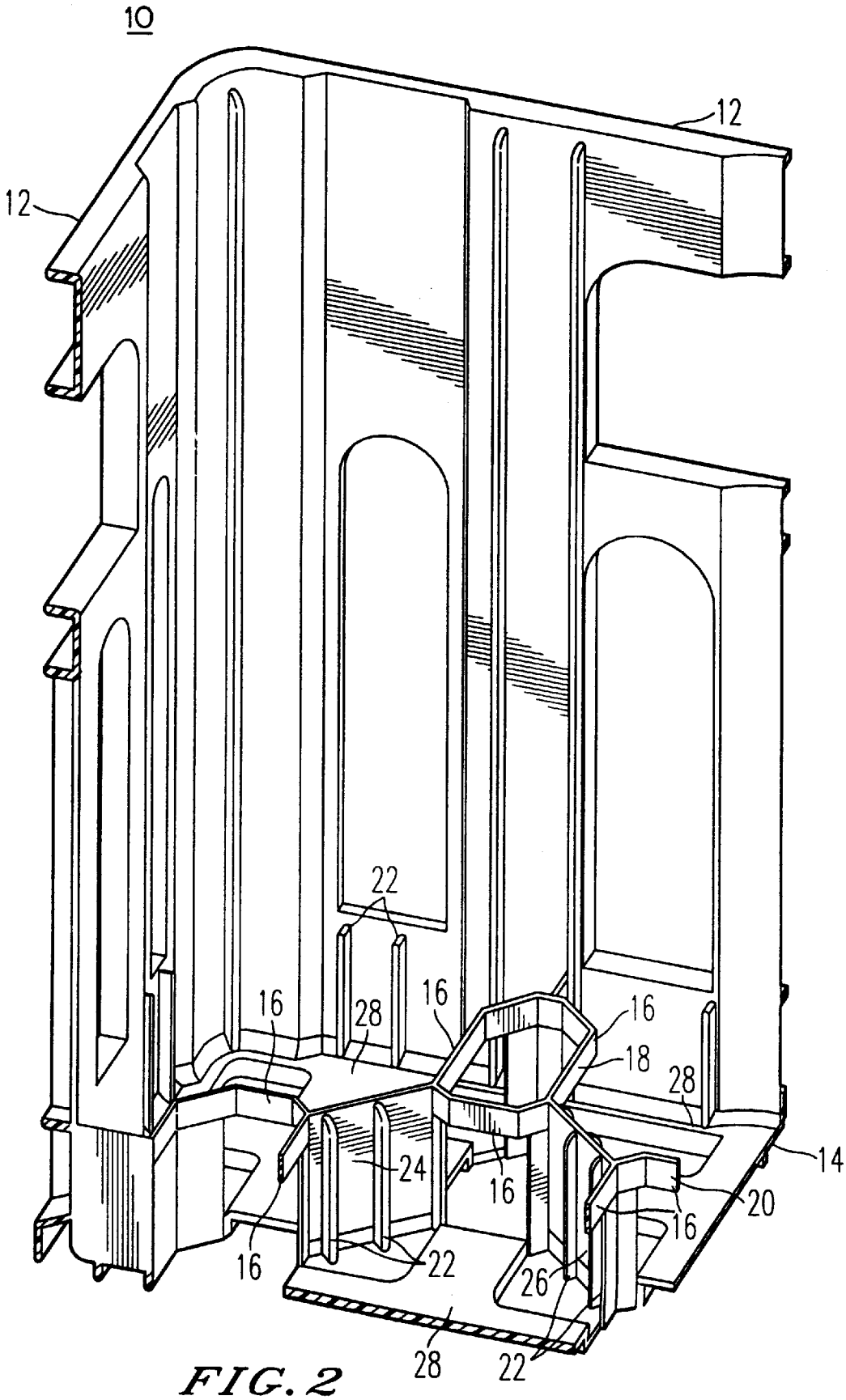
FIG. 2 is a partial perspective cross-sectional view taken along the line 2—2 of FIG. 1.

FIG. 2 is a partial perspective cross-sectional view taken along line 2—2 of FIG. 1. FIG. 2 shows the placement of the full-depth walls 12, the bottom structure 14, the longitudinal ribs 16, pairs of perpendicular ribs 22, and part of a pocket 28 formed by the periphery of the connection between the longitudinal ribs 16 and the pairs of perpendicular ribs 22. The pairs of perpendicular ribs 22 are substantially located between the bottom structure 14 and the longitudinal ribs 16.

Figure 3:
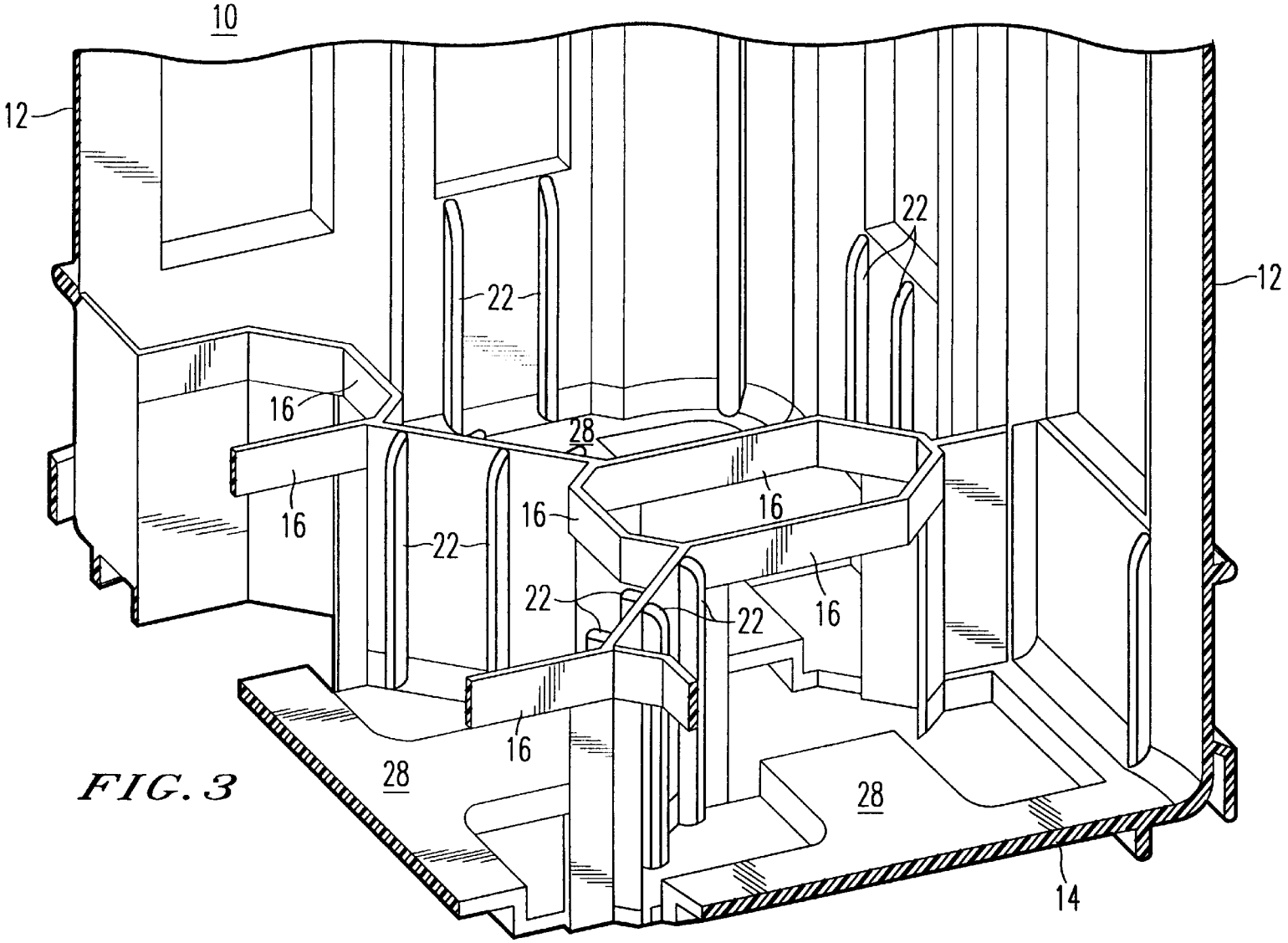
FIG. 3 is an enlarged partial perspective cross-sectional view of the cross-section of FIG. 2 taken from another angle.

FIG. 3 is a partial perspective cross-sectional view taken at an angle near the bottom of the cross-section shown in FIG. 2. Shown in FIG. 3 are the placement of the full-depth walls 12, the bottom structure 14, and the placement of the longitudinal ribs 16 and the pairs of perpendicular ribs 22 to form the pocket 28. As shown in FIGS. 2–5, the longitudinal ribs 16 are oriented parallel to the longitudinal plane of the bottom structure 14. Also as shown in FIGS. 2–6, opposing longitudinal ribs 16 form first sets of longitudinal ribs 18 and pairs of longitudinal ribs transverse to the first pair form a second set of longitudinal ribs 20. The pairs of perpendicular ribs 22 are used to form a first set of pairs of perpendicular ribs 24. Two more sets of pairs of perpendicular ribs 22 form second sets of perpendicular ribs 26 which are oriented substantially transverse to the first set of pairs of perpendicular ribs 24. Each pair of perpendicular ribs 22 substantially faces towards a center of a container 30 contained in the pocket 28.

Figure 4:
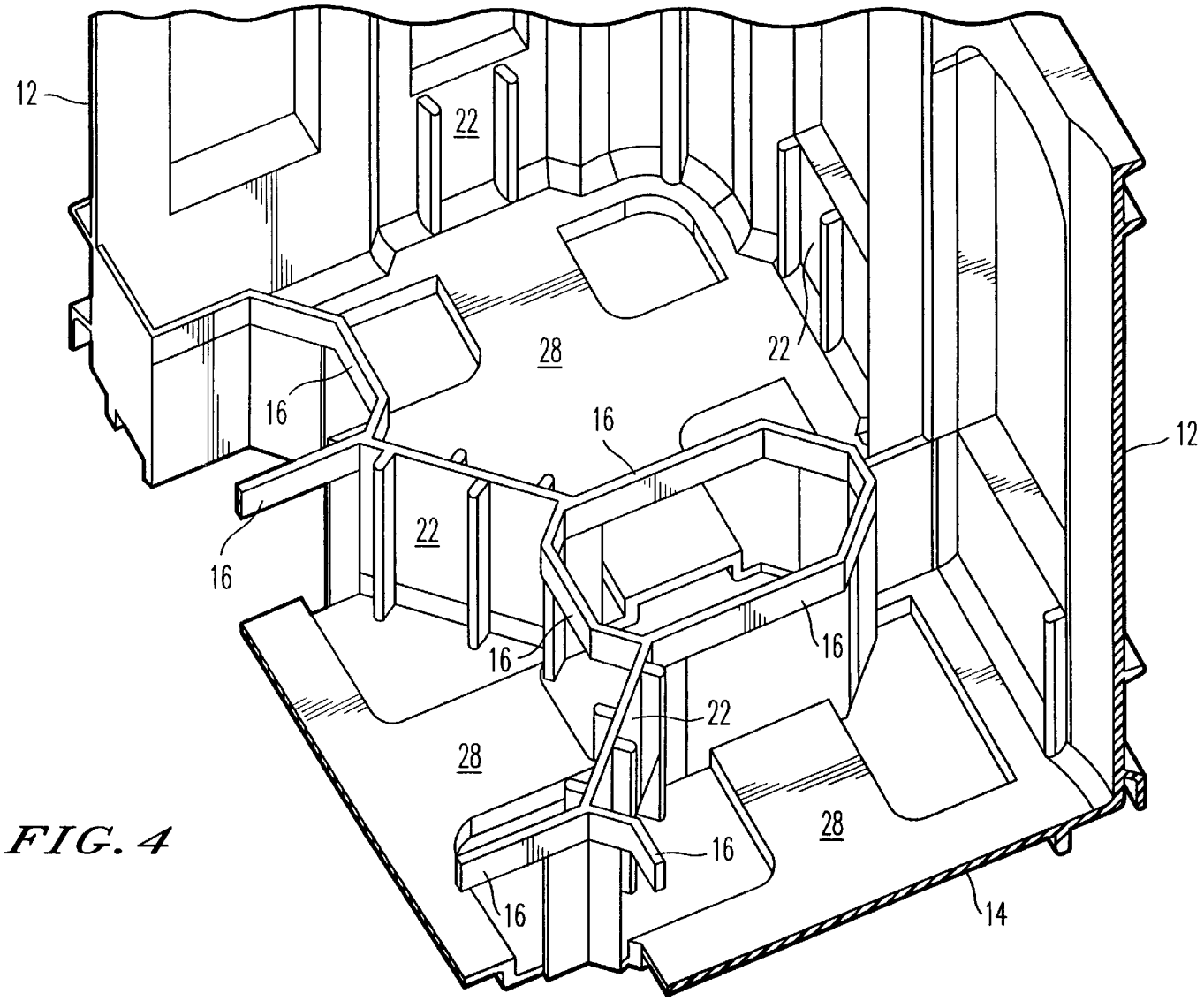
FIG. 4 is an enlarged partial perspective cross-sectional view of the cross-section of FIG. 2 taken from another angle.

FIG. 4 is a partial perspective cross-sectional view taken at an angle near the bottom of the cross-section shown in FIG. 2 showing the features of the invention.

Figure 5:
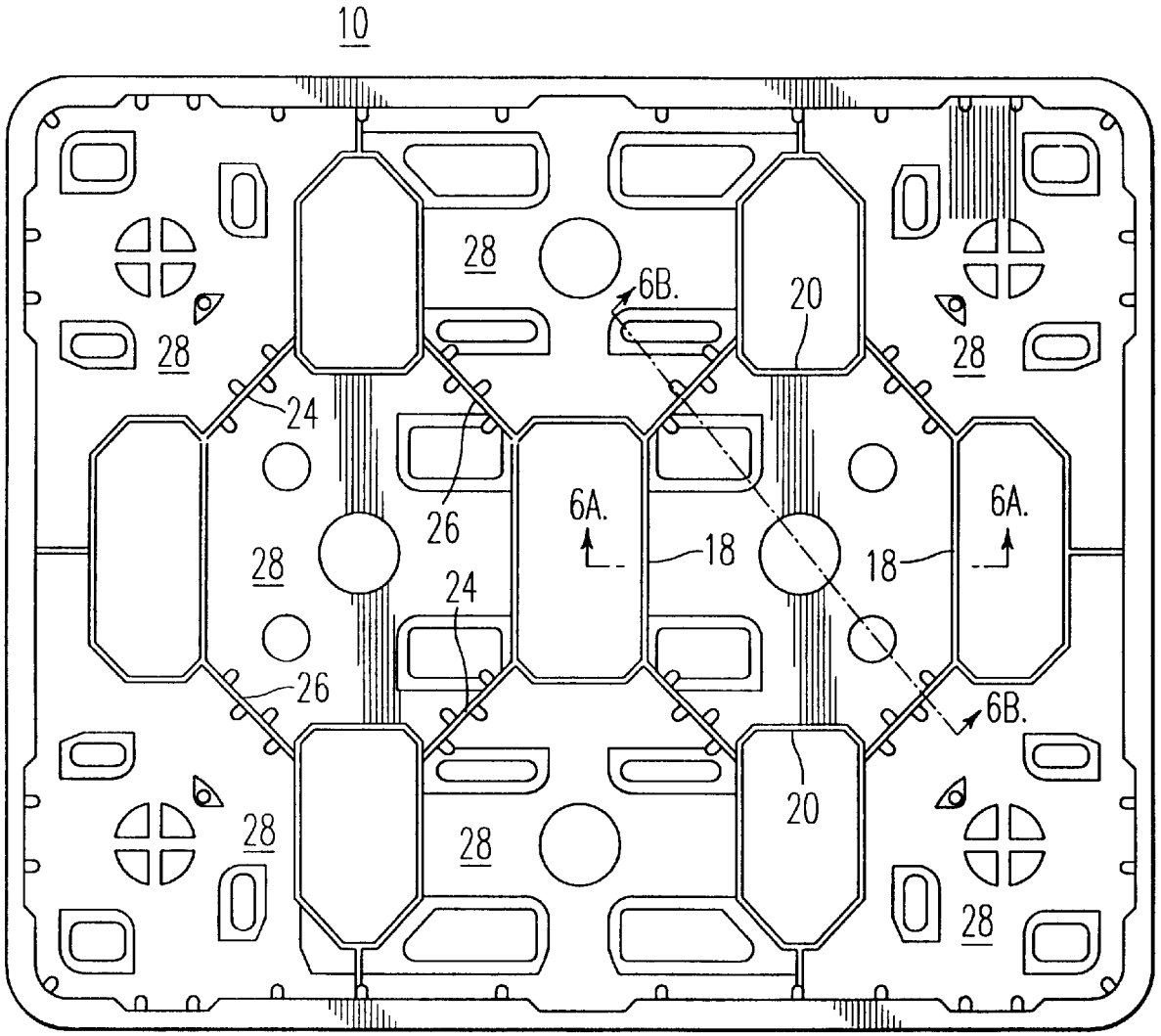
FIG. 5 is a top view of the anti-rotational box.
Figure 6A:
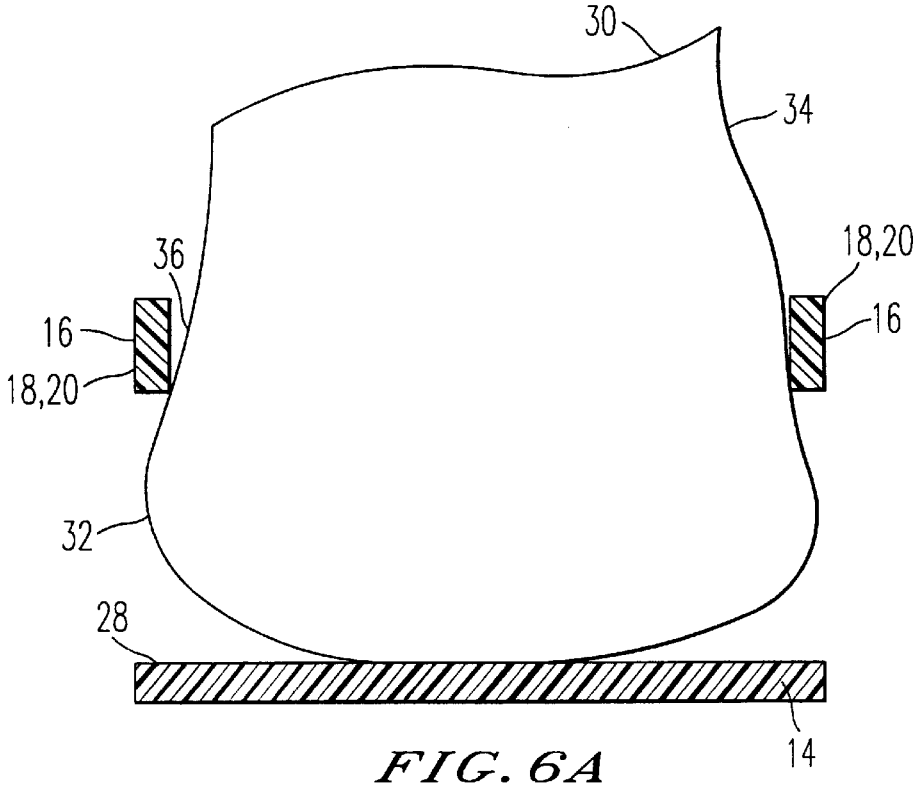
FIGS. 6A and 6B are partial cross-sections of a pocket of the anti-rotational box with a container inserted taken along lines 6A—6A and 6B—6B, respectively, of FIG. 5
Figure 6B:
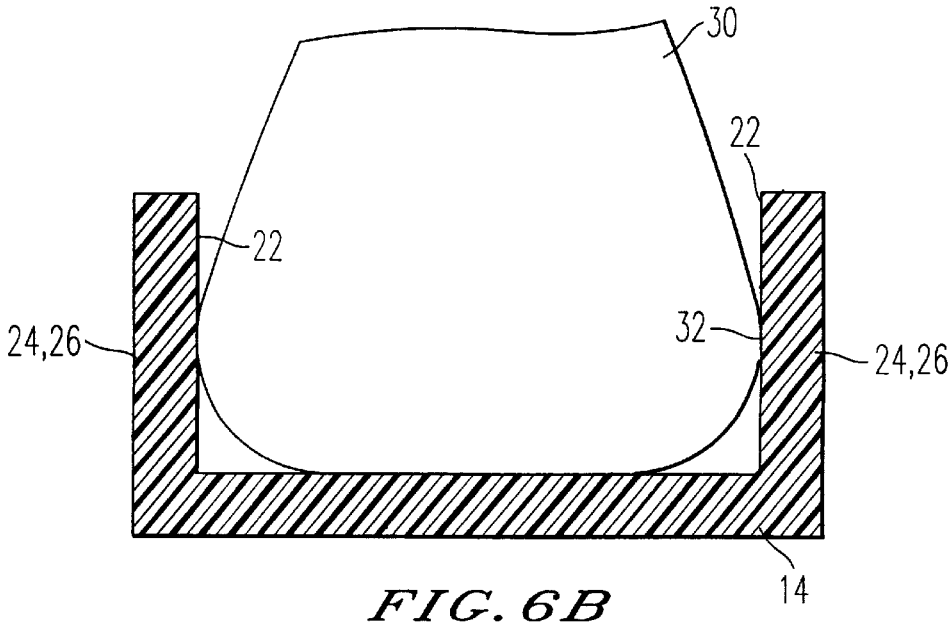

FIG. 5 is a top view of the anti-rotational box 10 showing pockets 28. FIGS. 6A and 6B are partial cross-sectional view through a pocket 28 as shown in FIG. 5.

FIGS. 6A and 6B show the interaction between a container 30 and a pocket 28 of the anti-rotational box 10. The cross-section illustrated in FIG. 6B is located approximately forty-five degrees to the cross-section of illustrated in FIG. 6A. FIG. 6A shows the container 30 and its interaction with the longitudinal ribs 16. Furthermore, the opposing, parallel pairs of longitudinal ribs 16 can exemplify either one of the first and second sets of longitudinal ribs 18, 20, as shown in FIG. 6A. FIG. 6B shows the container 30 and its interaction with the pairs of perpendicular ribs 22. Additionally, the opposing, parallel sets of pairs of perpendicular ribs 22 can exemplify either one of the first and second sets of pairs of perpendicular ribs 24, 26, as shown in FIG. 6B.

The anti-rotational box 10 is molded as a single structure. The height of the full-depth walls 12 of the anti-rotational box 10 are long enough to fully cover the height of the container 30 inserted therein. Such depth provides that multiple anti-rotational boxes 10 may be stacked on top of each other or cross stacked atop each other. The anti-rotational box is preferably made of a polymeric material. The difference in distance between the maximum diameter 32 of the container 30 and the length between the set of longitudinal ribs 18, 20 is such that when the container 30 is inserted into the anti-rotational box 10 the longitudinal ribs 18, 20 elastically press against the container 30. The difference in distance between the maximum diameter 32 of the container 30 and the length between the sets of pairs of perpendicular ribs 24, 26 is such that when the container 30 is inserted into the anti-rotational box 10 the perpendicular ribs 24, 26 press against the container 30. The container 30 is preferably made of PET. The container contains two liters of fluid. However, the invention can be used with any size of container.

In operation a container 30 is inserted into the pocket 28. The container has a non-uniform diameter forming a waist. The container 30 has a maximum diameter 32, a minimum diameter 34, and a transition region 36 which is located in between the maximum and minimum diameters, as shown in FIGS. 6A and 6B. The maximum diameter 32 of the container 30 is first introduced past the longitudinal ribs 16. The spacing between opposing longitudinal ribs 16 of a pocket 28 are such that the maximum diameter 32 of the container 30 tends to elastically deform the longitudinal ribs 16 outward. Upon further insertion of the container 30 into the pocket 28 the longitudinal ribs 16, due to their elastic nature, tend to return towards their initial position as the longitudinal ribs 16 come into contact with the transition region 36 of the container 30 which has a diameter smaller than that of the maximum diameter 32. As the maximum diameter 32 of the container 30 proceeds past the longitudinal ribs 16 the maximum diameter 32 of the container 30 comes into contact with the pairs of perpendicular ribs 22. Opposing pairs of perpendicular ribs 24, 26 are dimensioned a distance from each other so that the maximum diameter 32 of the container 30 contacts the pairs of perpendicular ribs 22. Together, both opposing pairs of perpendicular ribs 24, 26 form a substantially rigid portion. Together, both opposing pairs of first and second longitudinal ribs 18, 20 form an elastic portion. Once the container 30 is fully inserted into the pocket 28 the pairs of perpendicular ribs 22 of the first and second sets of pairs of perpendicular ribs 24, 26, and the longitudinal ribs 16 of the first and second sets of longitudinal ribs 18, 20 are in contact with the surface of the bottle 30 at the maximum diameter 32 and at the transition region 36, respectively. The container 30 is securely supported by the anti-rotational box 10. The containers 30, as secured above, does not rotate nor does it lean sufficiently so as to contact adjacent containers. Therefore, the surfaces of adjacent containers 30 do not touch and as such the adjacent surfaces of the containers 30 do not abrade each other. As such, the containers 30 may be refilled and reused.

Furthermore, one of ordinary skill in the art would be able to use the invention of the pocket configuration 28 of the anti-rotational system in a structure, such as a shelf, to secure containers therein, while the containers are stored and/or displayed. The invention of the anti-rotational system can also be used to secure containers having a single diameter along the length of the container's body.

Obviously, numerous modifications and variations of the present invention are possible in light of the above teachings. It is therefore to be understood that within the scope of the appended claims, the invention may be practiced otherwise than as specifically described herein.

I claim:

1. A box for holding containers of non-uniform diameters, comprising:

an exterior box structure including at least one wall having a height at least as great as a height of the containers to be stored in the box; and means for forming a plurality of pockets within said exterior box structure, wherein said plurality of pockets have a substantially rigid portion for engaging a maximum diameter of the container and an elastic portion for engaging a diameter of the container which is smaller than the maximum diameter of the container with sufficient force so as to prevent rotation of the container in the box.

2. A box as recited in claim 1, wherein said substantially rigid portion includes pairs of perpendicular ribs connected to said exterior box structure, said pairs of perpendicular ribs connected to a bottom structure of said exterior box structure.

3. A box as recited in claim 2, wherein said pairs of perpendicular ribs are substantially located between said bottom structure and said elastic portion.

4. A box as recited in claim 2, wherein said substantially rigid portion includes first sets of pairs of perpendicular ribs, each first set of pairs of perpendicular ribs formed by two substantially parallel pairs of perpendicular ribs, and second sets of pairs of perpendicular ribs, each second set of pairs of perpendicular ribs formed by two substantially parallel pairs of perpendicular ribs, said second sets of pairs of perpendicular ribs oriented in planes being substantially perpendicular to planes in which said first sets of pairs of perpendicular ribs exist, wherein said first and second sets of pairs of perpendicular ribs contact the maximum diameter of the container upon insertion of the container into the box, and wherein each of said first and second pairs of perpendicular ribs face towards a center of said container secured in said pocket.

5. A box as recited in claim 4, wherein said pairs of perpendicular ribs are substantially located between said bottom structure and said elastic portion.

6. A box as recited in claim 2, wherein said elastic portion includes longitudinal ribs connected to said exterior box structure.

7. A box as recited in claim 6, wherein said longitudinal ribs being located above said bottom structure and being substantially parallel to said bottom structure.

8. A box as recited in claim 7, wherein said elastic portion includes first sets of longitudinal ribs, each first set of longitudinal ribs formed by two parallel facing longitudinal ribs, and second sets of longitudinal ribs, each second set of longitudinal ribs formed by two parallel facing longitudinal ribs, said second sets of longitudinal ribs oriented substantially transverse to said first sets of longitudinal ribs, wherein said first and second sets of longitudinal ribs elastically flex upon insertion of the container into the box so as to accommodate the maximum diameter of the container, said first and second longitudinal ribs elastically return towards an initial position so as to contact said diameter of the container which is smaller than the maximum diameter of the container after the maximum diameter of the container has passed by adjacent pairs of first and second longitudinal ribs.

9. A box for holding containers, comprising:

an exterior box structure including at least one wall having a height at least as great as a height of the containers to be stored in the box; and means for forming a plurality of pockets within said exterior box structure, wherein said plurality of pockets have a substantially rigid portion for engaging a diameter of the container and an elastic portion for engaging the diameter of the container with sufficient force so as to prevent rotation of the container in the box.

10. A system for holding containers, comprising:

a structure for storing a container; and means for forming a plurality of pockets within said structure, wherein said plurality of pockets have a substantially rigid portion for engaging a diameter of the container and an elastic portion for engaging the diameter of the container with sufficient force so as to prevent rotation of the container in the structure.

* * * * *